United States Patent [19]

De Luca

[11] Patent Number: 4,901,663

[45] Date of Patent: Feb. 20, 1990

[54] METHOD OF INDICATING TOWEL ROLL DEPLETION

[75] Inventor: Raymond F. De Luca, Samford, Conn.

[73] Assignee: Georgia-Pacific Corporation, Atlanta, Ga.

[21] Appl. No.: 205,864

[22] Filed: Jun. 13, 1988

[51] Int. Cl.[4] ..... G08B 5/00

[52] U.S. Cl. ..... 116/200; 116/201; 206/390; 242/1; 242/55.2; 428/906

[58] Field of Search ..... 33/128, 733; 40/299, 40/360, 514; 116/200, 102, 278, DIG. 1, DIG. 6, DIG. 14; 206/459, 389, 390; 225/17, 18; 242/1, 55.2; 428/194, 906; 281/5

[56] References Cited

U.S. PATENT DOCUMENTS

| | | | |
|---|---|---|---|
| 1,935,970 | 11/1933 | Wooster et al. | 116/200 |
| 2,215,052 | 9/1940 | Price et al. | 225/8 |
| 2,780,352 | 2/1957 | Schroeder | 206/389 |
| 3,158,938 | 12/1964 | Philipps | 33/128 |
| 4,161,249 | 7/1979 | Dashow | 206/459 |

*Primary Examiner*—William A. Cuchlinski, Jr.
*Assistant Examiner*—W. Morris Worth
*Attorney, Agent, or Firm*—Banner, Birch, McKie & Beckett

[57] ABSTRACT

A system of indicating towel roll depletion in rolled towel dispensers. The end of the towel roll is treated with two ink or dye stripes, one longer than the other. Due to capillary action, the stripes carry a short distance across the surface of the towel. When enough toweling is consumed to reach the longer stripe, a series of single coding marks appear along the edge of the towel, indicating that the roll has been reduced to stub size. As more toweling is used, the shorter mark is reached and a series of double coding marks appear along type edge of the towel. The double marks indicate that the end of the roll is imminent.

14 Claims, 1 Drawing Sheet

METHOD OF INDICATING TOWEL ROLL DEPLETION

BACKGROUND OF THE INVENTION

The present invention generally relates to the field of towel roll dispensers, and more particularly, is directed to a method of indicating when a towel roll has reached stub roll size and is near completion.

In designing commercial roll towel dispensers, it is important to signal the approaching depletion of the roll in order to minimize the amount of time wasted by the service attendant. If the amount of toweling which remains on the roll is not accurately signaled to the attendant, the attendant may be needlessly compelled to open the dispenser in order to visually check the amount of remaining towels. Such a practice is wasteful of time which in a commercial environment can become quite expensive. In addition, the absence of an indication of remaining towelling usually results in an erroneous assumption that sufficient towelling remains. Thus, the dispenser is likely to become inadvertently depleted, thereby frustrating the recipient user.

In many applications, the towel dispenser attendant routinely replaces the towel roll on a regular basis without regard to how much towelling remains on the roll. Such a practice reduces the likelihood that the dispenser will become depleted inadvertently but has the economic disadvantage that the towelling on partially depleted rolls is discarded. Over time, the amount of towelling discarded in this manner can become a rather significant cost factor.

In order to overcame some of the above mentioned problems, a number of signaling devices have been developed for towel dispensers in order to gauge towel usage. Many of these devices rely on a mechanical linkage which moves contrasting color indicators in accordance with towel usage. The indicators are visible outside the dispenser and serve as a guage of how much towelling remains on the roll.

In addition to being expensive to implement, mechanical indicators often malfunction and are prone to alignment problems, thus requiring regular service calls by a person trained in the art of repairing such devices. The low reliability of prior art usage indicators, thus remains a problem with respect to towel dispensers.

A number of methods and schemes are known in the prior art for marking the towel in order to indicate the amount of towelling remaining on the roll. For example, U.S. Pat. No. 2,215,052 to Price et al. discloses one such scheme wherein the towels are provided with a series of notches. As the towel roll is used, the spacing between the notches becomes closer together to thereby provide a visual indication of the quantity of towels remaining on the roll. U.S. Pat. No. 3,158,939 to Phillipp's disclose a method of indicating the amount of filament remaining on a roll. Measuring marks are stamped on the end of the filament core to provide a visual indication of the quantity of filament left on the core. U.S. Pat. Nos. 1,935,970 and 4,161,249 to Wooster et al. and Dashow also disclose techniques for marking a towel roll with some form of a depletion mark.

While marking the towelling such as taught by the above patents, represents an improvement over mechanical guages incorporated into the dispenser, they do not provide the ideal solution. For example, the notches formed in the towels disclosed by Price requires the use of equipment cable of physically cutting the notches along the edge of the towel. Accurately cutting notches in a material having the consistency of a towel is difficult given the soft and plyable texture of towels. Thus, the notches are likely to have ragged and frayed edges, making the spacing between them somewhat randum and difficult to interpret as an indicator of towel depletion. In addition, notching is slow, requires special equipment and leaves less than a pleasing appearance to the towel.

The measuring marks taught by Phillipps is not helpful in a dispenser since the end of the towel core is usually not visible to the user.

The towel depletion mark suggested by the Wooster is a diagonal bar which runs the entire length of the roll. Progression of the bar across the face of the towel serves as an indicator of towel depletion. Implementation of this technique is also time consuming as it must be done in conjunction with the towelling being wound into a roll. Calibrating the position of the bar relative to the end of the roll requires rather complex equipment.

Thus, there remains a need for a roll depletion indicator which is reliable, low cost and easy to interpret.

SUMMARY OF THE INVENTION

It is the overall object of the present invention to provide a method of indicating towel roll depletion in a towel dispenser.

It is a specific object of the present invention to provide such a method which is reliable, efficient and economical to implement.

It is also a specific object of the present invention is to provide a method of indicating towel roll depletion which is fail-safe and easy to interpret.

these and other objects of applicant's invention are achieved by treating one end of the towel roll near the center with two ink or dye stripes, one longer than the other. Due to capillary action, the stripes carry a short distance across the surface of the towel. Both stripes extend outwardly from the towel core for selected distances. When enough toweling is consumed to reach the longer stripe, a series of single coding marks appear along the edge of the towel, indicating that the roll has been reduced to stub size. The roll can then be moved to the stub compartment of the dispenser. As more toweling is used, the shorter mark is reached and a series of double coding marks appear along the edge of the towel. The double marks indicate that the end of the roll is imminent. In addition, the spacing between coding marks decrease as more toweling is used which serves as a further visual indication of how much toweling remains on the roll.

DESCRIPTION OF THE PREFERRED EMBODIMENT

Figure 1:
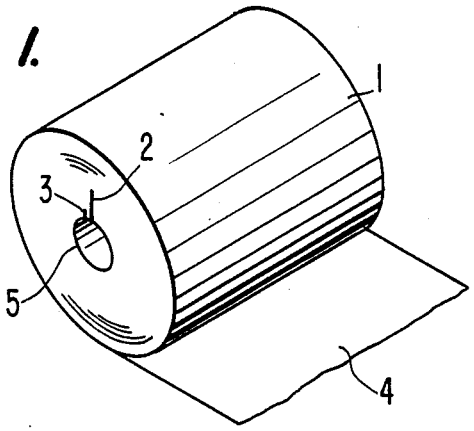
FIG. 1 is a perspective view of a towel roll incorporating the depletion coding method of applicant's invention.

FIG. 1 illustrates a towel roll 1 which has depletion stripes 2 and 3 in accordance with the present invention.

As shown in Figure 1, first and second dye strips 2 and 3 extend outwardly from core 5 of towel roll 1. Stripes 2 and 3 are formed by application of a dye stain along the edge of roll 1 which, by capillary action, carries a short distance across the surface of web 4. Stripes 2 and 3 may be applied by automatic striping equipment located on the towel roll coverting line or at any other convenient place along the manufacturing process.

As can be seen in FIG. 1, strip 2 is substantially longer than strip 3 and is, therefore, reached first when towelling is dispensed by pulling web. 4. The length of strip 2 determines where along roll 1 applicant's method of towel depletion indication begins. Strip 2 should be made sufficiently long such that enough towelling remains on roll 1 that an attendant alerted to the end of the roll being near, has sufficient time to actually change the roll before it is depleted.

Figure 2:
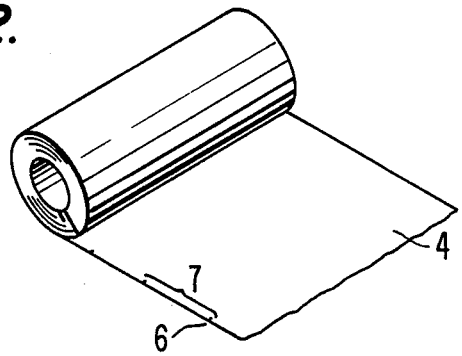
FIG. 2 is a perspective view illustrating a first series of coding marks across the surface of the towelling of FIG. 1.

Strip 2 causes single coding marks 6 to be formed along the edge of web 4 as can be seen in FIG. 2. The visibility of coding marks 6 provides a first signal that the end of the roll is near and will need changing in the not to distant future. This signal serves as an indicator that stub roll size has been reached, when in some dispensers is the correct diameter to be placed in a stub roll compartment of a dispenser which is designed for that type of operation.

The spacing between coding marks 6 provides a second towel depletion signal. As more towelling is used, spacing 7 becomes smaller. Thus strip 2 provides two separate and distinct signals indicating the amount of towelling remaining on the roll.

Figure 3:
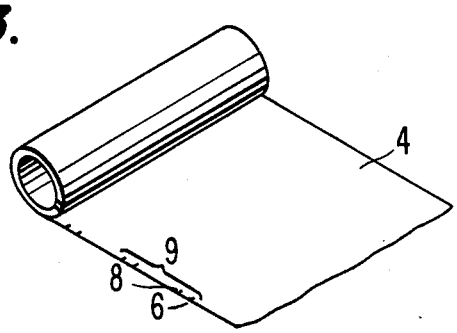
FIG. 3 is a perspective view illustrating a first and second series of coding marks across the surface of the towelling of FIG. 1.

When enough towelling is consumed to reach strip 3, a second series of coding marks 8 is formed on web 4 as shown in FIG. 3. The appearance of the second series of coding marks provides a third depletion signal which, depending on the length of strip 3, serves as an indicator that the end of the roll is imminent. The length of strip 3 can be adjusted to provide the third signal when any convenient amount of towelling remains on the roll.

The spacing 9 between pairs of coding marks 6 and 8 also continues to decrease as more towelling is used, to thereby provide a fourth depletion signal.

The towel depletion signals of applicant's invention, thus provides a low cost, reliable and efficient alternative to the methods and apparatus offered by the prior art.

While there is shown and described herein certain specific features of this invention, it will be manifest to those skilled in the art that various modifications may be made without departing from the spirit and scope of the underlying inventive concept and that this invention is not limited to the particular forms herein shown and described except insofar as indicated by the scope of the appended claims.

I claim:

1. A method of indicating depletion of a rolled web material, said method comprising the steps of making a list dye stripe mark of a predetermined length in a radially outward direction along one side of said roll; and allowing said stripe mark to penetrate said one side of said roll to form a first plurality of coding marks adjacent to and spaced along one edge of said web the distance between said spaced coding marks decreasing and being viewable by a user as said roll is depleted, wherein the presence of said first plurality of coding marks provides a first indication of the amount of web material on said roll.

2. The method of claim 1 wherein the spacing between said first plurality of coding marks provides a second indication of the amount of web material on said roll, said second indication changing in accordance with the amount of web material on said roll.

3. The method of claim 1 further including the step of:

making a second shorter dye stripe mark adjacent said first stripe along said one side of said roll and allowing said second stripe mark to penetrate said one side of said roll to form a second plurality of coding marks along said one edge of said web, wherein the presence of said first and second plurality of coding marks along said one edge of said web provides a third indication of the amount of web material on said roll.

4. The method of claim 3 wherein the spacing between successive pairs of said first and second plurality of coding marks provides a fourth indication of the amount of web material on said roll, said fourth indication changing in accordance with the amount of web material on said roll.

5. The method of claim 3 wherein said second plurality of coding marks cooperates with said first plurality of coding marks to provide a fourth indication of the amount of web material on said roll, said fourth indication changing in accordance with the amount of web material on said roll.

6. The method of claim 2 wherein said spacing between said first plurality of coding marks corresponds to the amount of web material on said roll.

7. The method of claim 4 wherein said spacing between successive pairs of said first and second plurality of coding marks corresponds to the amount of web material on said roll.

8. A roll of web material having a center portion around which said web is rolled, the improvement comprising:

a first dye stripe mark formed along one side of said roll and extending radially outward away from said center portion for a predetermined distance, said stripe being absorbed into said web to thereby form a first plurality of spaced coding marks along one edge of said web, the distance between said spaced coding marks decreasing and being viewable by a user as said roll is depleted, wherein the presence of said first plurality of coding marks provides a first indication of the amount of web material on said roll.

9. The towel roll of claim 8 wherein the spacing between said first plurality of coding marks provides a second indication of the amount of web material on said roll, said second indication changing in accordance with the amount of web material on said roll.

10. The towel roll of claim 9 further including a second shorter dye stripe mark formed along said one side of said roll and extending outwardly away from said center portion adjacent said first stripe mark, said second stripe mark being absorbed into said web to thereby form a second plurality of spaced coding marks along said one edge of said web, wherein the presence of said first and second plurality of coding marks along said one edge of said web provides indications of the amount of web material on said roll, 11. The towel roll of claim 10 wherein the spacing between successive pairs of said first and second plurality of coding marks provides a fourth indication of the amount of web material on said roll, said fourth indication changing in accordance with the amount of web material on said roll.

12. The towel roll of claim 10 wherein said second plurality of coding marks cooperates with said first plurality of coding marks to provide a fourth indication of the amount of web material on said roll, said fourth indication changing in accordance with the amount of web material in said roll.

13. The towel roll of claim 8 wherein said spacing between said first plurality of coding marks corresponds to the amount of web material on said roll.

14. The towel roll of claim 10 wherein said spacing between successive pairs of said first and second plurality of coding marks corresponds to the amount of web material on said roll.

* * * * *